US011383795B2

(12) United States Patent
Giottoli

(10) Patent No.: US 11,383,795 B2
(45) Date of Patent: Jul. 12, 2022

(54) CRAFT WITH DEVICE FOR MOVEMENT OF A STERN PLATFORM PROVIDED WITH INTEGRATED STEPS

(71) Applicant: FERRETTI S.P.A., Cattolica (IT)

(72) Inventor: Massimo Giottoli, Forli (IT)

(73) Assignee: FERRETTI S.P.A., Cattolica RN (IT)

( * ) Notice: Subject to any disclaimer, the term of this patent is extended or adjusted under 35 U.S.C. 154(b) by 163 days.

(21) Appl. No.: 16/929,484

(22) Filed: Jul. 15, 2020

(65) Prior Publication Data

US 2021/0016857 A1 Jan. 21, 2021

(30) Foreign Application Priority Data

Jul. 19, 2019 (IT) ..... 102019000012366

(51) Int. Cl.
*B63B 29/00* (2006.01)
*B63B 27/14* (2006.01)

(52) U.S. Cl.
CPC ..... *B63B 29/00* (2013.01); *B63B 27/14* (2013.01); *B63B 27/146* (2013.01)

(58) Field of Classification Search
CPC . B63B 27/14; B63B 2027/141; B63B 27/143; B63B 2027/145; B63B 27/146; B63B 2027/148; B63B 29/00; B63B 2029/022
See application file for complete search history.

(56) References Cited

U.S. PATENT DOCUMENTS 4,733,752 A * 3/1988 Sklar ..... B63B 27/14 182/86
7,162,969 B2 1/2007 Houlder et al.
(Continued)

FOREIGN PATENT DOCUMENTS

AU 2014253511 B1 1/2016
DE 202009007140 U1 9/2009
(Continued)

OTHER PUBLICATIONS

Search Report and Written Opinion dated Mar. 6, 2020 for Italian patent application No. 102019000012366.

*Primary Examiner* — Ajay Vasudeva
(74) *Attorney, Agent, or Firm* — Vorys, Sater, Seymour and Pease LLP

(57) ABSTRACT

Craft including hull having stern with mobile platform having first work position where it is extracted from water, and second work position where it is immersed in water, device for platform movement having a pantograph, a structure with an articulated quadrilateral connected to the mobile platform, said movement and a unit for actuating movement of this structure, which unit allows moving the platform from the first to second work position and vice versa. The structure with articulated quadrilateral folded back onto hull when platform is in first position, and extended when platform is in second position. The movement device includes a body distinct from hull. The structure with articulated quadrilateral integral with, but mobile relative to body. The body secured on hull stern and having at least one fixed step, at least one second step inside the structure with articulated quadrilateral, which step moveable and foldable back with the structure.

20 Claims, 6 Drawing Sheets

(56) References Cited

U.S. PATENT DOCUMENTS

| | | | | |
|---|---|---|---|---|
| 8,091,294 | B2 * | 1/2012 | Whalen | A01K 1/035<br>52/182 |
| 8,671,869 | B2 * | 3/2014 | Muller | B63B 27/14<br>114/362 |
| 8,833,290 | B2 * | 9/2014 | Mueller | B63B 27/30<br>114/343 |
| 2011/0017122 | A1 | 1/2011 | Mueller | |
| 2020/0148310 | A1 * | 5/2020 | Grimaldi | B63B 27/16 |

FOREIGN PATENT DOCUMENTS

| | | | | |
|---|---|---|---|---|
| DE | 202009007144 | U1 * | 9/2009 | B63B 23/32 |
| DE | 102018133044 | A1 * | 6/2020 | |
| EP | 2479104 | A1 * | 7/2012 | B63B 23/32 |
| WO | 2016116771 | A1 | 7/2016 | |

* cited by examiner

CRAFT WITH DEVICE FOR MOVEMENT OF A STERN PLATFORM PROVIDED WITH INTEGRATED STEPS

This claims the benefit of Italian patent application no. 102019000012366, filed Jul. 19, 2019, hereby incorporated by reference in its entirety.

FIELD OF THE INVENTION

The subject of the present invention is a craft or boat.

BACKGROUND OF THE INVENTION

For some time boats have been known, such as yachts or the like, with a hull which, in the aft part, have a stern platform or aft defined by a plane which projects orthogonally from the hull, and can act as a "swimming platform" for passengers of the craft. This platform or swimming platform can be fixed or mobile relative to the hull: in this last case, the platform or a portion thereof can move relative to the hull, and can adopt any position at least between a first position of work projecting from the hull and adhering thereto, and a second portion in which the platform is totally immersed in the water on which the boat is located.

Craft are also known with an aft opening which for example is used to contain a small boat or tender. This opening is usually closed by its own aft hatch.

In the case in which the craft has the aft opening, and in the case in which the platform is secured on the hull, the presence of this swimming platform can be an obstacle to easy access to the aft opening directly from the sea.

For this reason, in the case of a hull with an aft opening, it is preferable to produce these platforms provided with at least one mobile part, such that access to and from the sea via this opening can be cleared.

Usually, the mobile aft platforms are connected to the hull of the craft by means of guides which are integral with the hull (for example of the telescopic, or fixed and straight type), or by means of articulated on pantograph supports which, when the aft opening is opened, translate the corresponding platform relative to the hull, but with a circular trajectory. One or more movement devices permit the passage of the mobile platform from the first position of work to the second and vice versa.

In the case of articulated supports, when the platform is immersed in the water, it may not be easy to go from the platform to the hull of the boat in order to get back up onto the boat or vice versa, because a support with a pantograph with a curved trajectory tends to move the platform (or swimming platform) away from the craft.

In the case when use of a tender is planned for example, the immersion of the platform in the water on the one hand facilitates launching of the tender and getting onto this tender by the passengers, but on the other hand it may make it difficult for the passengers themselves to get back up onto the boat, (from which the tender has been put into the water).

It is therefore known to associate small step ladders with the mobile platforms in order to facilitate the passage of people from the platform immersed in the water to the hull of the craft.

For example, DE 20 2009 007140 U1 describes a craft or boat with a mobile stern platform which can be kept out of the water on which the boat is located, or it can be carried under the surface of the water by means of movement devices with a pantograph with articulated quadrilaterals, hinged on the hull of the boat and rotatable around these hinges.

The German prior art describes that a small step ladder is integral with the platform, which ladder is invisible (or "disappears") when the platform is in the first position of work alongside the hull and out of the water: on the other hand this small step ladder is on view when the platform goes into the second position of work and is immersed in the water. When the platform is completely immersed (i.e. it is in the second position of work), the small step ladder is completely on view and is used to reach the hull of the boat easily and get up onto the hull starting from the platform immersed in the water.

According to one embodiment, the small step ladder is hinged at one of its ends on the platform, whereas at the other end it is hinged on the hull. According to another embodiment, the small step ladder is freely supported on the mobile platform, and can slide in a guided manner inside a recess or seat present on said hull.

In the known prior solution, the small step ladder is thus an independent unit, separate from any movement device of the platform.

WO2016/116771 describes a craft with an aft hatch which is mobile between a vertical position closed on an aperture of an aft opening, and a horizontal position, in which it reaches the water. This hatch is moved by devices with articulated arms which are subjected to actuators. Between these arms there are present mobile elements which are hinged on these arms, which, in the horizontal position of the hatch, define a plurality of steps. The movement of these mobile elements is obtained by means of further units, which are hinged to one another, and are subjected to further actuator units which thus permit the rotation of these elements which, as stated, when the hatch is horizontal, define steps, whereas when the hatch is vertical they are also disposed vertically, rotated and lying on the same plane.

This known solution is complex, it has substantial dimensions, and requires large stern spaces in order to be able to position the mobile elements and their movement units.

U.S. Pat. No. 7,162,969 describes a craft with a mobile stern platform which can be placed in at least two positions of work, i.e. a first position close to a stern bridge of the boat, and a second position lowered towards the water. The platform slides on straight guides, and is superimposed on fixed steps provided in the hull at the stern of the boat, which steps are released when the platform moves towards the second position. This solution uses fixed steps provided in the hull, and which substantially occupy all of the stern, these steps being independent elements on said stern. In addition, the platform slides on inclined guides which are provided in the stern, and is not detached from the hull during this movement.

SUMMARY OF THE INVENTION

The objective of the present invention is to provide a craft, particularly a watercraft or boat, with a mobile aft platform and with a device for movement of the platform with a pantograph with an articulated quadrilateral, which is improved relative to the similar known crafts.

In particular, the objective of the invention is to provide a craft of the aforementioned type with a mobile platform which can be reached by means of steps when it is in the second position of work immersed at least partly in the water, wherein the presence of the steps is compact, and wherein these steps are obtained in a simple manner, without requiring large surfaces available in the aft part of the hull, and without implementing or adding other components in use.

Another objective of the invention is to provide a craft of the aforementioned type wherein every movement device of the platform can be obtained simply, and can be used where it is wished to move the platform with a non-linear movement device, and which has limited dimensions.

These objectives and others which will become apparent to persons skilled in the art are achieved by a craft according to the appended claims.

BRIEF DESCRIPTION OF THE DRAWINGS

For better understanding of the present invention, purely by way of non-limiting example, the following drawings are appended, in which.

DETAILED DESCRIPTION OF THE INVENTION

Figure 1:
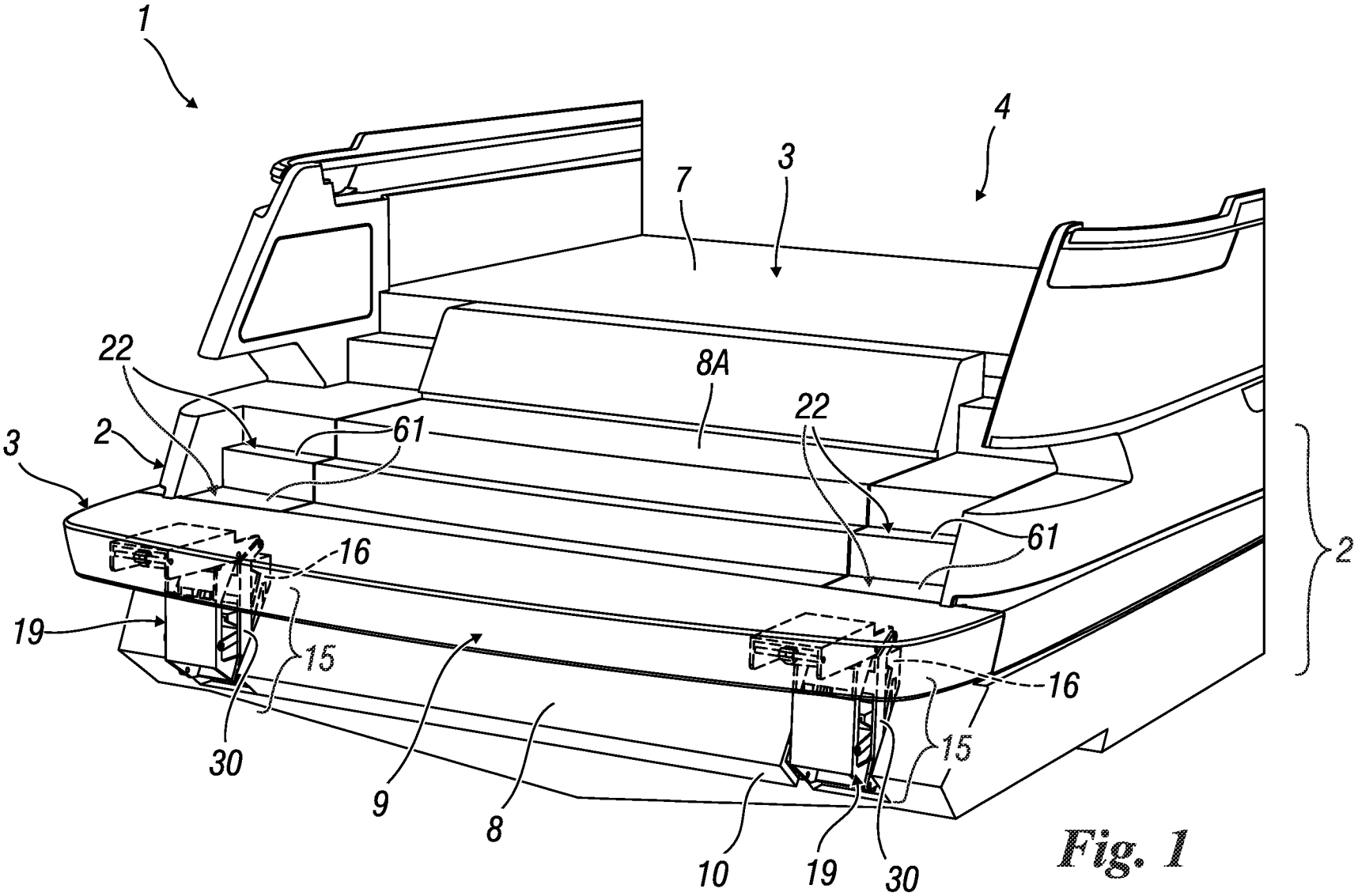
FIG. 1 shows an example of a perspective view of the stern of a craft (in particular a watercraft) produced according to the invention, with a mobile platform in a first position of work.

With reference to the aforementioned figures, a craft according to the invention is generally indicated as 1, and comprises a hull 2 with a stern and an aft area 4. In the stern 3 there is advantageously provided an aperture 5 which leads to an aft opening 6 preferably placed below a bridge 7. The aperture 5 of the aft opening is closed at the bottom in the embodiment shown by a hatch 8 associated with a mobile stern platform 9.

Figure 2:
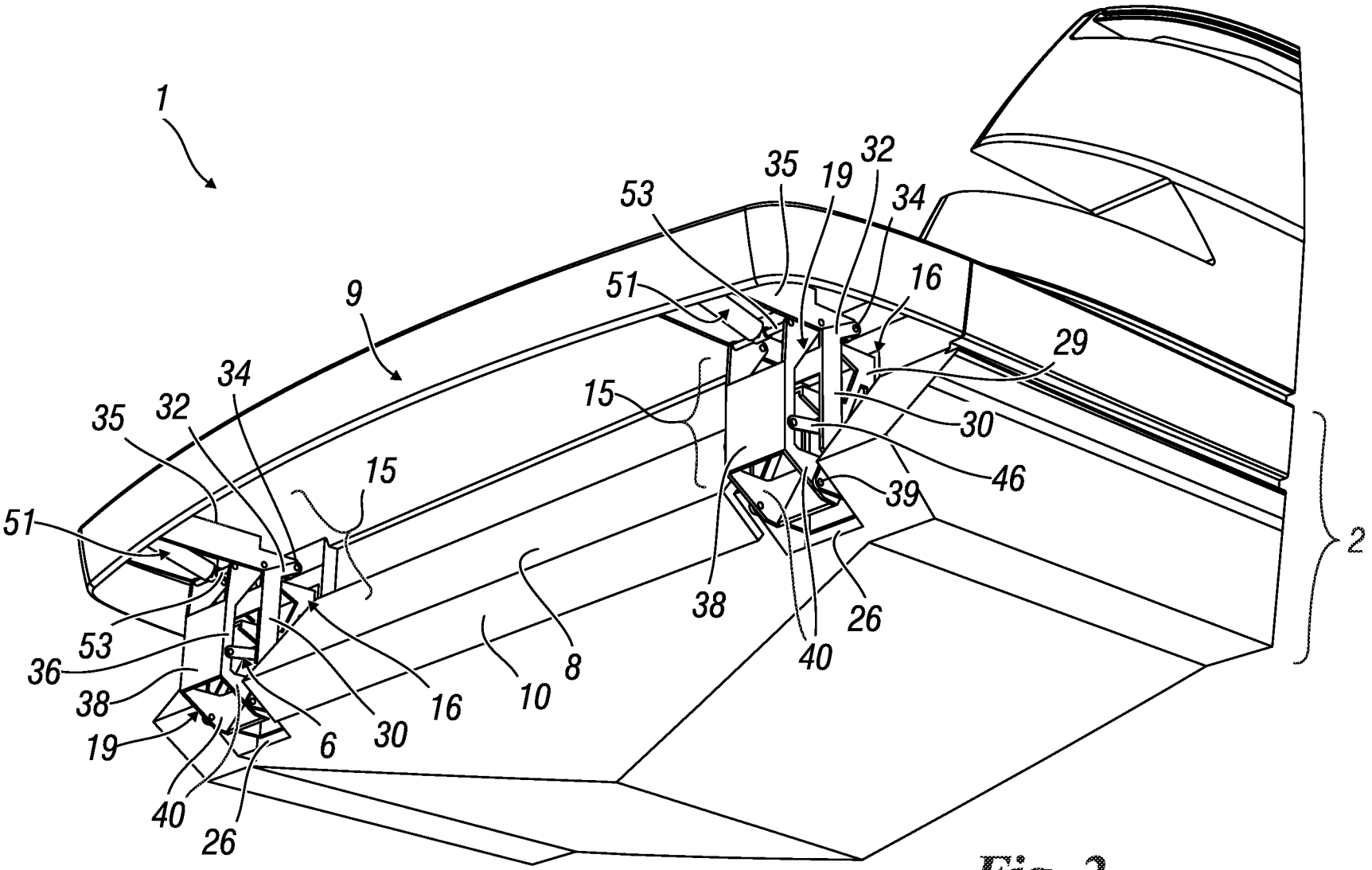
FIG. 2 shows a perspective view from below of the stern of the craft in FIG. 1.
Figure 3:
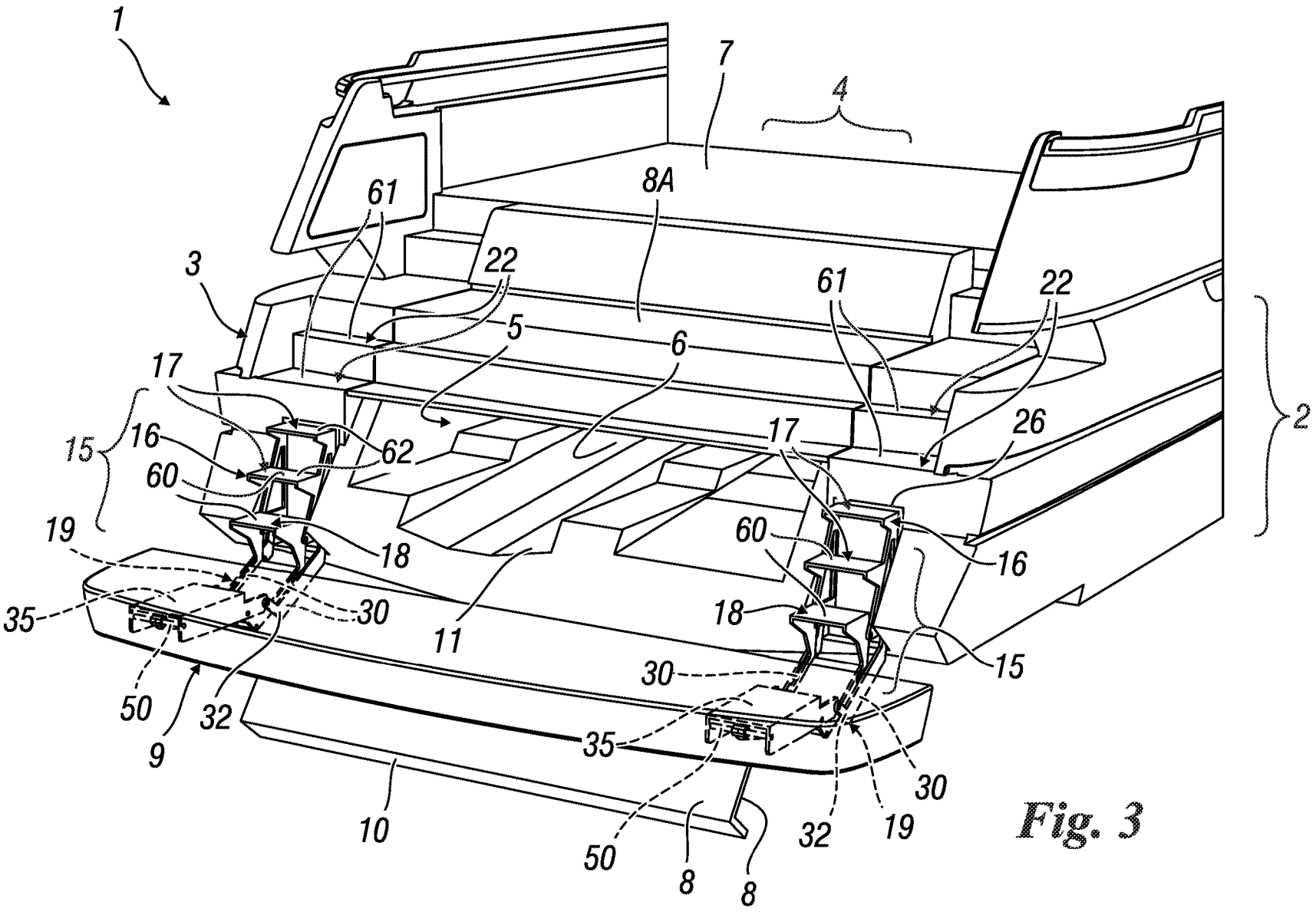
FIG. 3 shows a perspective view of the stern of the craft in FIG. 1, but with the platform in the second position of work.

This platform can adopt at least two positions of work: in a first position (FIGS. 1 and 2) the platform is substantially extracted from the water (or is placed slightly above the surface of the water) on which the boat is placed, and in this case, the hatch 8, placed below the platform (see FIG. 2), closes the aperture 5 at the bottom. It should be noted that the hatch 8 has an end part 10 which is formed such as to obtain lower adherent closure of this aperture 5, in particular by means of an end position 11 thereof. It will be appreciated that the aperture 5 is closed at the top by another hatch 8A (shown closed in FIGS. 1 and 3) which is mobile in any known manner. In a second position of work (FIG. 3), the platform 9 is immersed in the water and is placed below the aperture 5 of the opening 6, with reference to the level of the water, which can thus at least reach a lower edge of the aperture 5 (in a direction parallel to the stern 3) and permit entry into the water and extraction therefrom of any tender (not shown) which may be admitted into the opening 6.

The platform 9 moves relative to the hull by means of at least one movement device 15 (two in the figures) of the pantograph type, i.e. of the type which distances said platform from the hull 2 when it is open. The number of movement devices depends on the dimensions of the platform 9, and on whether it is completely mobile, or alternatively only a part of it can be moved relative to another part which is secured on the hull.

Figure 4:
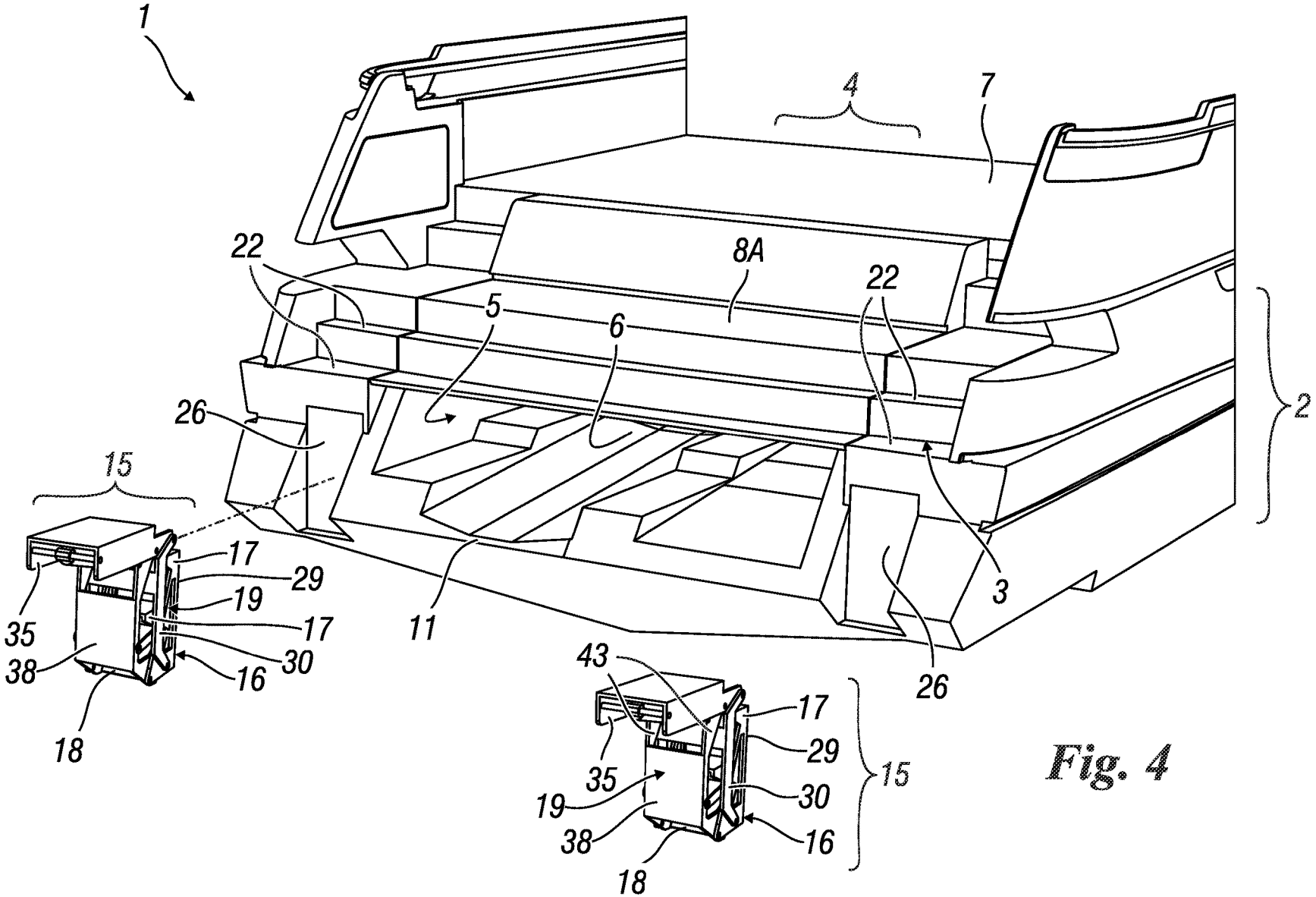
FIG. 4 shows a view similar to that of FIG. 1, exploded and with some parts removed the sake of greater clarity.
Figure 5:
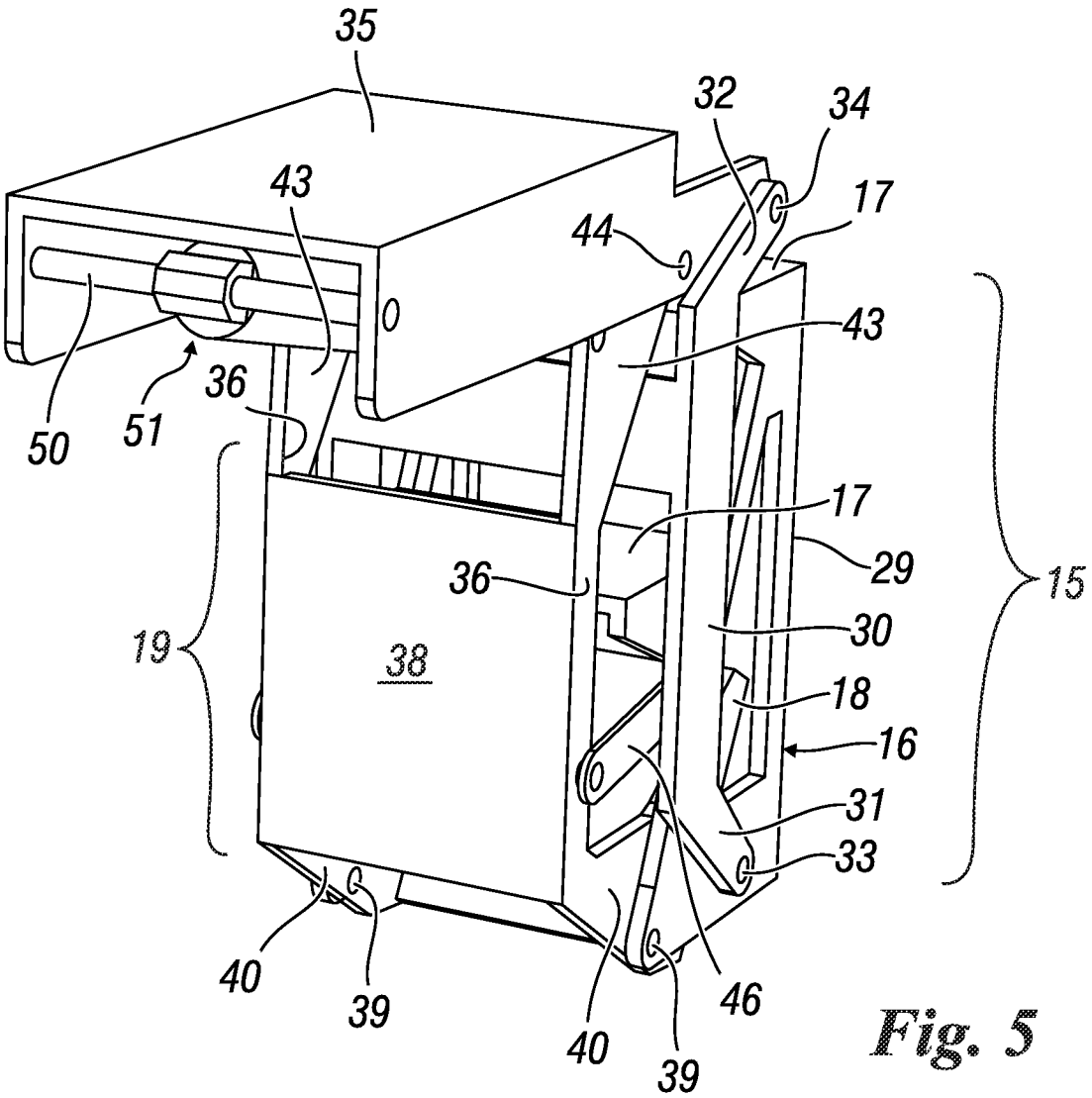
FIG. 5 shows a perspective view of a part of the craft in FIG. 1.

In order to reach the platform in its second position of work, at least one of the movement devices 15 (both in the figures) comprises a fixed body 16 with at least one fixed step 17 (two in the figures), at least one second step 18 (which is mobile) being present in a structure 19 with an articulated quadrilateral of the movement device 15 with a pantograph supporting the platform 9 directly; said structure 19 is integral with this body 16 (see FIG. 4 and FIG. 5).

In other words, said movement device contains in itself the steps which make it possible to reach the platform 9 when it is immersed in the water, said steps being accessible when the device with a pantograph extends, and being covered by the structure 19 with an articulated quadrilateral when the device 15 is folded back.

This makes it possible to obtain a simple and compact structure for providing the steps for access to the platform 9 in the second position of work. It should also be noted that these steps 17 and 18 are placed in line with fixed steps 22 provided directly in the stern 3, and which make it possible to reach the platform 9 when it is in the first position of work (from the bridge 7). In other words, the steps 17 and 18 follows the fixed steps 22 consecutively.

More particularly, each movement device 15 shown in the figures comprises the body 16 which is altogether distinct and autonomous relative to the structure (and therefore with respect to the hull 2) of the craft 1 (see FIG. 4) and is secured inside a recess or seat 26 of the stern 3 by any known means. In the figures, the body 16 comprises a frame 29 which supports the fixed steps 17. The frame 29 supports hinged external arms 30 which have first and second ends 31 and 32; the end 31 is hinged at 33 on the frame 29 and the (second) end 32 is hinged at 34 on a plate 35 which is secured on the platform 9.

With the frame 29 there are associated internal arms 36 supporting the mobile step 18. These arms, which are connected by a plate 38, are hinged at 39, by means of a first end 40, on the frame 29, and by means of a second end 43 they are hinged at 44 on the plate 35. Small intermediate arms 46 can connect the external arms to the internal arms when the kinematics of the system necessitate this.

In the case presented, the plate 35 supports a transverse pin 50, to which there is connected an actuator unit 51, such as an oleodynamic or pneumatic or hydro-pneumatic cylinder, or a cylinder of another type such as electrical or with a rotary mechanism. In particular, a first part of this unit 51 (for example a piston) is connected to this pin 50, whereas the second part (for example the cylinder) is connected to a transverse pin 53 connecting the internal arms 36.

Figure 6:
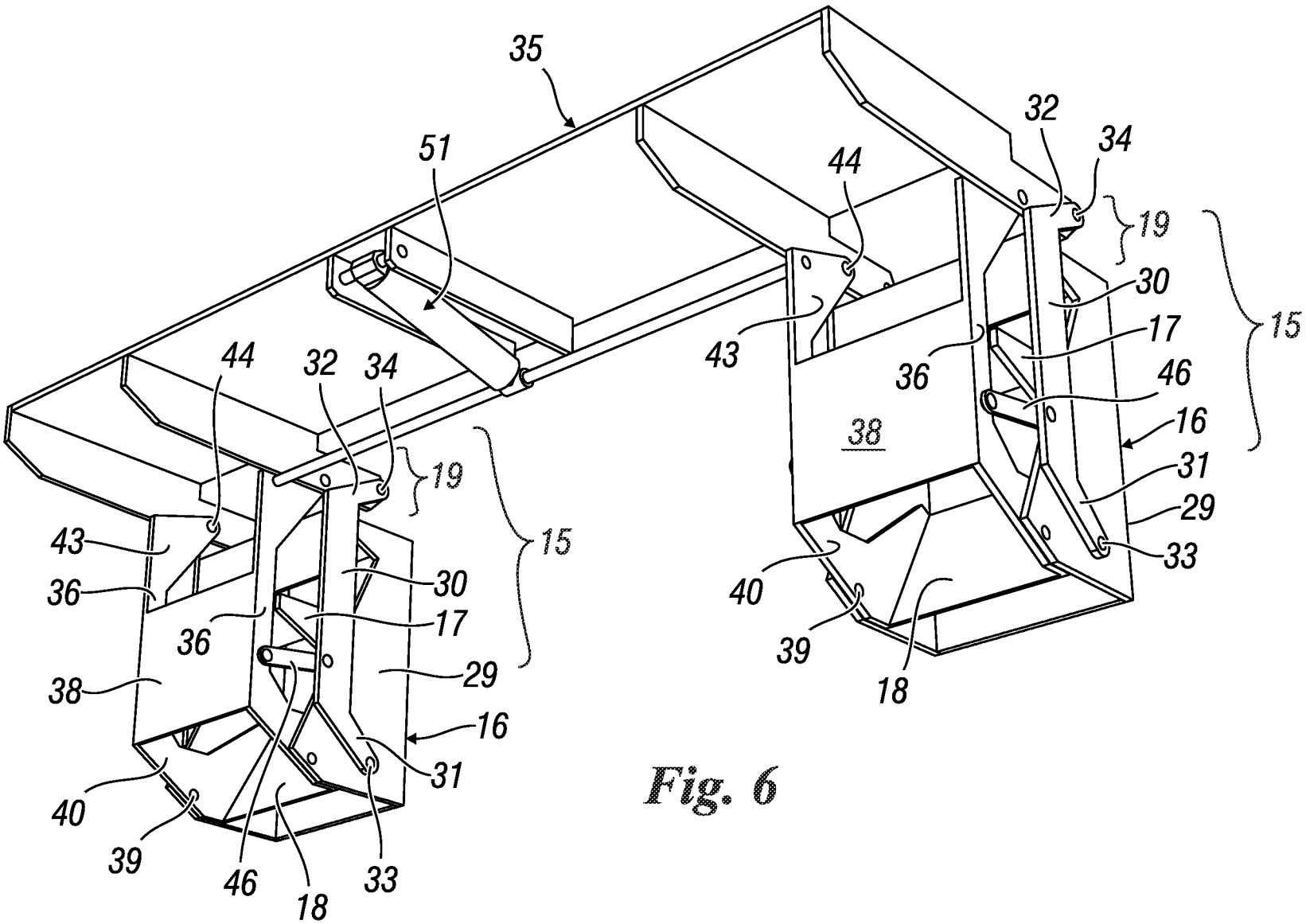
FIG. 6 shows a perspective view from below of a variant of the invention.

In the variant in FIG. 6, the plate 35 is common to the two devices 15 represented, and below it is placed a single actuator 51 for both said devices 15.

The external arms 30 and the internal arms 36 define the structure 19 with an articulated quadrilateral previously referred to.

At the moment of actuation of each actuator unit 51 in order to move the platform from the first position of work (FIGS. 1 and 2) to the second position of work (FIG. 3), the arms 30 and 36 rotate around the hinges or pins 33 and 39 (respectively) which connect them to the fixed frame 29, whereas the platform 9 is detached from the hull 2 supported by each plate 35 (on which there are hinged the arms 30 and 36). With the rotation of the two arms 30 and 36, including also the one containing the step 18, around the pins 33 and 39 of the body 16, the translation with a circular trajectory of the platform 9 is transmitted by means of hinging at 34 and 44. When the platform 9 reaches the second position of work, the step is then positioned in line with the fixed steps 17 of the body 16 (i.e. with their flat part 62 in the position of use parallel to the flat parts 61 of the fixed steps 22). Vice versa, when the platform 9 is taken to the first position of work, the rotation of the arms of the articulated quadrilateral 19 takes the flat part 60 of the mobile step 18 into the vicinity of the hull 2, whereas said structure 19 is positioned in the vicinity of the hull, accommodating the fixed steps inside itself.

Thanks to the above-described solution, there is a simple and compact embodiment of steps which make it possible to reach the platform 9 easily when it is in its second position of work, by coming down from the bridge 7 (and vice versa) by using the space of the movement device. This device thus incorporates steps for reaching this platform.

The above-described solution can be applied to stern spaces which do not have enough room to accommodate elsewhere the steps or also their stern space without a storage unit.

Finally, it should be noted that the movement device 15 can be pre-assembled, and then be connected to the hull only after the device has been obtained. This facilitates the creation of the actuator device "with incorporated steps" and implementation of the normal "unloaded" operating tests without the presence of the platform (or the hull).

A preferred embodiment of the invention has been described. However, others can also be provided, such as those which have additional mobile and/or fixed steps, or which have components selected according to the type of boat on which the invention is applied. These solutions are also considered to be included in the scope of the present document.

The invention claimed is:

1. A craft comprising:

a hull having a stern with a mobile platform which can adopt at least two positions of work, in a first one of which the platform is extracted from the water, and in the second one of which it is immersed in the water, at least one movement device being provided for movement of the platform, said movement device being of the type with a pantograph, and having a structure with an articulated quadrilateral connected to the mobile platform, said movement device comprising a unit for actuation of the movement of the structure with the articulated quadrilateral, which unit can allow the platform to move from the first position of work to the second and vice versa, said structure with the articulated quadrilateral being folded back onto the hull when the platform is in the first position of work, and being extended when the platform is in the second position of work, wherein said movement device comprises a body which is distinct from the hull, the structure with the articulated quadrilateral being integral with, but mobile relative to the body, said body being secured on the hull and having at least one fixed step, at least one second step being disposed inside the structure with the articulated quadrilateral, the second step can be moved and folded back together with said structure, said steps being contained inside the structure with the articulated quadrilateral when the platform is in its first position of work, wherein said body secured on the hull comprises a frame which supports each fixed step, the structure with the articulated quadrilateral being hinged on said frame, wherein the structure with the articulated quadrilateral comprises external arms with first and second ends which are hinged respectively on the frame of the body secured on the hull, and are hinged on a plate which is secured on the platform, internal arms which support the second step being hinged on said frame, said internal arms being rotatable around said hinges which connect the arms to the frame of the body which is secured on the hull when the movement device is actuated.

2. The craft according to claim 1, wherein said movement device is pre-assembled before being connected to the hull.

3. The craft according to claim 1, wherein the body of the movement device is inserted and secured inside a seat provided in the stern of the hull.

4. The craft according to claim 1, wherein said internal arms are hinged on the plate which is connected to the platform.

5. The craft according to claim 1, wherein the unit for actuation of the movement device is inside the structure with the articulated quadrilateral.

6. The craft according to claim 1, wherein the unit for actuation is functionally connected to the internal arms.

7. The craft according to claim 1, wherein said at least one movement device comprises a plurality of movement devices to move the mobile platform, which devices are actuated by a single said unit for actuation.

8. The craft according to claim 1, wherein the step which is integral with the structure with the articulated quadrilateral has a flat part which is placed in the vicinity of the hull when the platform is in its first position of work, said flat part being placed parallel to the flat part of each step associated with the body secured on the hull when the platform is in its second position of work.

9. The craft according to claim 1, wherein the craft is a watercraft.

10. The craft according to claim 1, wherein the craft is a boat.

11. A craft comprising:

a hull having a stern with a mobile platform which can adopt at least two positions of work, in a first one of which the platform is extracted from the water, and in the second one of which it is immersed in the water, at least one movement device being provided for movement of the platform, said movement device being of the type with a pantograph, and having a structure with an articulated quadrilateral connected to the mobile platform, said movement device comprising a unit for actuation of the movement of the structure with the articulated quadrilateral, which unit can allow the platform to move from the first position of work to the second and vice versa, said structure with the articulated quadrilateral being folded back onto the hull when the platform is in the first position of work, and being extended when the platform is in the second position of work, wherein said movement device comprises a body which is distinct from the hull, the structure with the articulated quadrilateral being integral with, but mobile relative to the body, said body being secured on the hull and having at least one fixed step, at least one second step being disposed inside the structure with the articulated quadrilateral, the second step can be moved and folded back together with said structure, said steps being contained inside the structure with the articulated quadrilateral when the platform is in its first position of work, wherein said at least one movement device comprises a plurality of movement devices to move the mobile platform, which devices are actuated by a single said unit for actuation.

12. The craft according to claim 11, wherein said movement device is pre-assembled before being connected to the hull.

13. The craft according to claim 11, wherein the body of the movement device is inserted and secured inside a seat provided in the stern of the hull.

14. The craft according to claim 11, wherein the unit for actuation of the movement device is inside the structure with the articulated quadrilateral.

15. The craft according to claim 11, wherein the step which is integral with the structure with the articulated quadrilateral has a flat part which is placed in the vicinity of the hull when the platform is in its first position of work, said flat part being placed parallel to the flat part of each step associated with the body secured on the hull when the platform is in its second position of work.

16. The craft according to claim 11, wherein the craft is a watercraft.

17. The craft according to claim 11, wherein the craft is a boat.

18. A craft comprising:

a hull having a stern with a mobile platform which can adopt at least two positions of work, in a first one of which the platform is extracted from the water, and in the second one of which it is immersed in the water, at least one movement device being provided for movement of the platform, said movement device being of the type with a pantograph, and having a structure with an articulated quadrilateral connected to the mobile platform, said movement device comprising a unit for actuation of the movement of the structure with the articulated quadrilateral, which unit can allow the platform to move from the first position of work to the second and vice versa, said structure with the articulated quadrilateral being folded back onto the hull when the platform is in the first position of work, and being extended when the platform is in the second position of work, wherein said movement device comprises a body which is distinct from the hull, the structure with the articulated quadrilateral being integral with, but mobile relative to the body, said body being secured on the hull and having at least one fixed step, at least one second step being disposed inside the structure with the articulated quadrilateral, the second step can be moved and folded back together with said structure, said steps being contained inside the structure with the articulated quadrilateral when the platform is in its first position of work, wherein the body of the movement device is inserted and secured inside a seat provided in the stern of the hull.

19. The craft according to claim 18, wherein said movement device is pre-assembled before being connected to the hull.

20. The craft according to claim 18, wherein the body of the movement device is inserted and secured inside a seat provided in the stern of the hull.

* * * * *